US006446303B1

(12) United States Patent
Paterson et al.

(10) Patent No.: US 6,446,303 B1
(45) Date of Patent: Sep. 10, 2002

(54) BAG ASSEMBLY FOR A VACUUM CLEANER

(75) Inventors: Chris M. Paterson, Long Beach, MS (US); Shane P. Cohen, Metairie, LA (US); Javier Verdura, Milford, CT (US)

(73) Assignee: Oreck Holdings, LLC, Cheyenne, WY (US)

( * ) Notice: Subject to any disclaimer, the term of this patent is extended or adjusted under 35 U.S.C. 154(b) by 22 days.

(21) Appl. No.: 09/675,473

(22) Filed: Sep. 29, 2000

(51) Int. Cl.[7] ..... A47L 9/14
(52) U.S. Cl. ..... 15/350; 15/410; 55/369
(58) Field of Search ..... 15/347, 350, 351, 15/410; 55/369

(56) References Cited

U.S. PATENT DOCUMENTS

| | | | | | |
|---|---|---|---|---|---|
| 2,241,601 | A | * | 5/1941 | Kessler | 55/299 |
| 2,672,642 | A | * | 3/1954 | Tamarin et al. | 15/323 |
| 3,203,551 | A | * | 8/1965 | Van Loan | 210/486 |
| 4,311,493 | A | * | 1/1982 | Schaefer et al. | 15/323 |
| 4,566,884 | A | * | 1/1986 | Jones et al. | 15/350 |
| 4,662,913 | A | * | 5/1987 | Vermillion | 15/351 |
| 4,748,713 | A | * | 6/1988 | Sepke et al. | 15/347 |
| 5,216,779 | A | * | 6/1993 | Glenn, III | 15/351 |
| 5,230,121 | A | * | 7/1993 | Blackman | 15/351 |
| 5,244,703 | A | * | 9/1993 | Bosses | 15/347 |
| 5,390,392 | A | * | 2/1995 | Thomas et al. | 15/339 |

OTHER PUBLICATIONS

Whirlpool disclosure brochure, Recieved Mar. 16, 1971; copy in 15/351.*

* cited by examiner

*Primary Examiner*—Chris K. Moore
(74) *Attorney, Agent, or Firm*—Faegre & Benson LLP

(57) ABSTRACT

An outer bag assembly for an upright vacuum cleaner is disclosed. The outer bag assembly comprises a flexible, air permeable enclosure having an internal volume adapted to contain a disposable inner bag. The outer bag assembly is further comprised of an upper end adapted to provide access to the internal volume through a closure device, and an opposite end attached to a handle assembly through a bag clip assembly. In one embodiment, the closure device includes a zipper disposed along an upper front peripheral edge of the outer bag assembly that allows a front panel of the bag assembly to be partially released. In another embodiment, the closure device includes a zipper disposed along an upper front peripheral edge, and a zipper disposed along an upper rear peripheral edge of the outer bag assembly that allows a top panel of the outer bag assembly to be partially released. In still another embodiment, the closure device includes a bag cap comprised of resilient thermoplastic sections hingeably connected to allow access to the internal volume of the bag assembly. In another embodiment, a bag clip assembly adapted to retain the opposite end of the bag is disclosed. In still other embodiments, abrasion-resistant outer panels that are affixed to the outer surfaces of the outer bag assembly are disclosed.

68 Claims, 11 Drawing Sheets

BAG ASSEMBLY FOR A VACUUM CLEANER

TECHNICAL FIELD

This invention relates generally to methods and apparatuses for collecting particulates from a flow of air transported through a vacuum cleaner.

BACKGROUND OF THE INVENTION

Conventional vacuum cleaners are widely available, and are useful in a number of cleaning applications. One type of vacuum cleaner, commonly known as the upright vacuum cleaner, is frequently used in both residential and commercial settings to remove particulates of various sizes from floor surfaces such as carpeting, wood flooring, or linoleum.

A typical upright vacuum cleaner according to the prior art is shown in FIG. 1. As shown therein, the upright vacuum cleaner 10 is comprised of a wheel-mounted head assembly 100 that is further comprised of an intake nozzle 115 positioned close to a floor surface 110. A blower (not shown) is generally located within the head assembly 100 that takes in a flow of air and entrained particulates through the intake nozzle 115, and discharges the flow of air into an outer bag assembly 120 that traps the entrained particulates while allowing the flow of air to be passed through the surface of the outer bag assembly 120 and returned to the surroundings. A handle assembly 112 extends generally upwardly from the head assembly 100 and is pivotally attached to the head assembly 100 by a pivot 114 so that a user can grasp and move the handle 118 while in a standing or walking position to conveniently and effectively move the head assembly 100 across the floor surface 110.

With reference still to the prior art upright vacuum cleaner depicted in FIG. 1, the outer bag assembly 120 is further comprised of an inner filter bag (not shown) positioned within the outer bag assembly 120. The inner bag is generally made from a paper material with relatively fine interwoven fibers to trap particulates transported into the inner bag by the flow of air. When the inner bag becomes filled with particulate matter, it is removed from the machine and discarded. The outer bag assembly 120 is generally made from a durable, woven, air permeable fabric that provides mechanical support to the relatively flexible inner bag, and generally protects the inner bag from tears or punctures that would allow the particulates trapped within the inner bag to escape. Additionally, the outer bag assembly provides secondary filtration that augments the primary filtration provided by the inner bag.

One difficulty encountered in the use of upright vacuum cleaners is providing access to the interior of the outer bag assembly so that the inner bag may be conveniently removed. Since the inner bag is substantially filled with fine particulate matter that may be easily scattered if the inner bag is mishandled during the removal process, the inner bag is generally slowly and carefully removed from the interior of the outer bag assembly to minimize particulate scattering. Outer bags used in some prior art upright vacuum cleaners have bag openings that extend longitudinally along the length of the bag, with a closure device such as a zipper, or VELCRO® to close the bag opening. As a consequence, to access the inner bag, the user must usually place the machine on a horizontal surface with the outer bag assembly oriented horizontally, or alternatively, if the machine is left in an upright position, remove the inner bag while in a kneeling position.

An additional difficulty encountered in the use of upright vacuum cleaners is providing an outer bag assembly that affords a firm and durable mechanical support for the inner bag. For the upright vacuum cleaner to remove particulates with maximum effectiveness, the inner bag must be permitted to fully inflate when the flow of air is established. Accordingly, the outer bag assembly must impart sufficient support to the inner bag to allow full inflation of the bag without developing folds, or other internal obstructions that would disrupt the flow of air within the inner bag. Prior art outer bag assemblies, as shown in FIG. 1, are generally fabricated from lightweight, substantially flexible air permeable fabrics, and consequently may not provide the required mechanical support. Furthermore, the outer bag assembly must substantially protect the inner bag from tearing or other physical damage that may result from physical abrasion encountered in normal use. For example, with reference again to the prior art device shown in FIG. 1, when the wheel-mounted head assembly 100 is moved substantially under furniture objects that are close to the floor surface 110 such as beds, chairs or tables, the handle 112 must usually be significantly lowered to allow the head assembly 100 to be moved under the object. Since the outer bag assembly 120 is generally frontally positioned on the handle assembly 112, the frontal surface of the outer bag assembly 100 may repeatedly contact the furniture object, subjecting the outer bag assembly 100 to physical wear that may ultimately affect the integrity of the outer bag assembly 100.

SUMMARY OF THE INVENTION

An outer bag assembly for an upright vacuum cleaner is disclosed. The outer bag assembly comprises a flexible, air permeable enclosure having an internal volume adapted to contain a disposable inner bag. The outer bag assembly is further comprised of an upper end adapted to provide access to the internal volume through a closure device, and an opposite end attached to a handle assembly through a bag clip assembly. In one aspect, the closure device includes a zipper disposed along an upper front peripheral edge of the outer bag assembly that allows a front panel of the bag assembly to be partially released. In another aspect, the closure device includes a zipper disposed along an upper front peripheral edge, and a zipper disposed along an upper rear peripheral edge of the outer bag assembly that allows a top panel of the outer bag assembly to be partially released. In still another aspect of the invention, the closure device includes a bag cap comprised of resilient thermoplastic sections hinged to allow access to the internal volume of the bag assembly. In a further aspect, a bag clip assembly adapted to retain the opposite end of the bag is disclosed. In still other aspects of the invention, abrasion-resistant outer panels that are affixed to the outer surfaces of the outer bag assembly are disclosed.

DETAILED DESCRIPTION OF THE INVENTION

The present invention is generally directed to an outer bag assembly for use with an upright vacuum cleaner. Many of the specific details of certain embodiments of the invention are set forth in the following description and in FIGS. 2 through 14 to provide a thorough understanding of such embodiments. One skilled in the art will understand, however, that the present invention may have additional embodiments, or that the present invention may be practiced without several of the details described in the following description.

Figure 1:
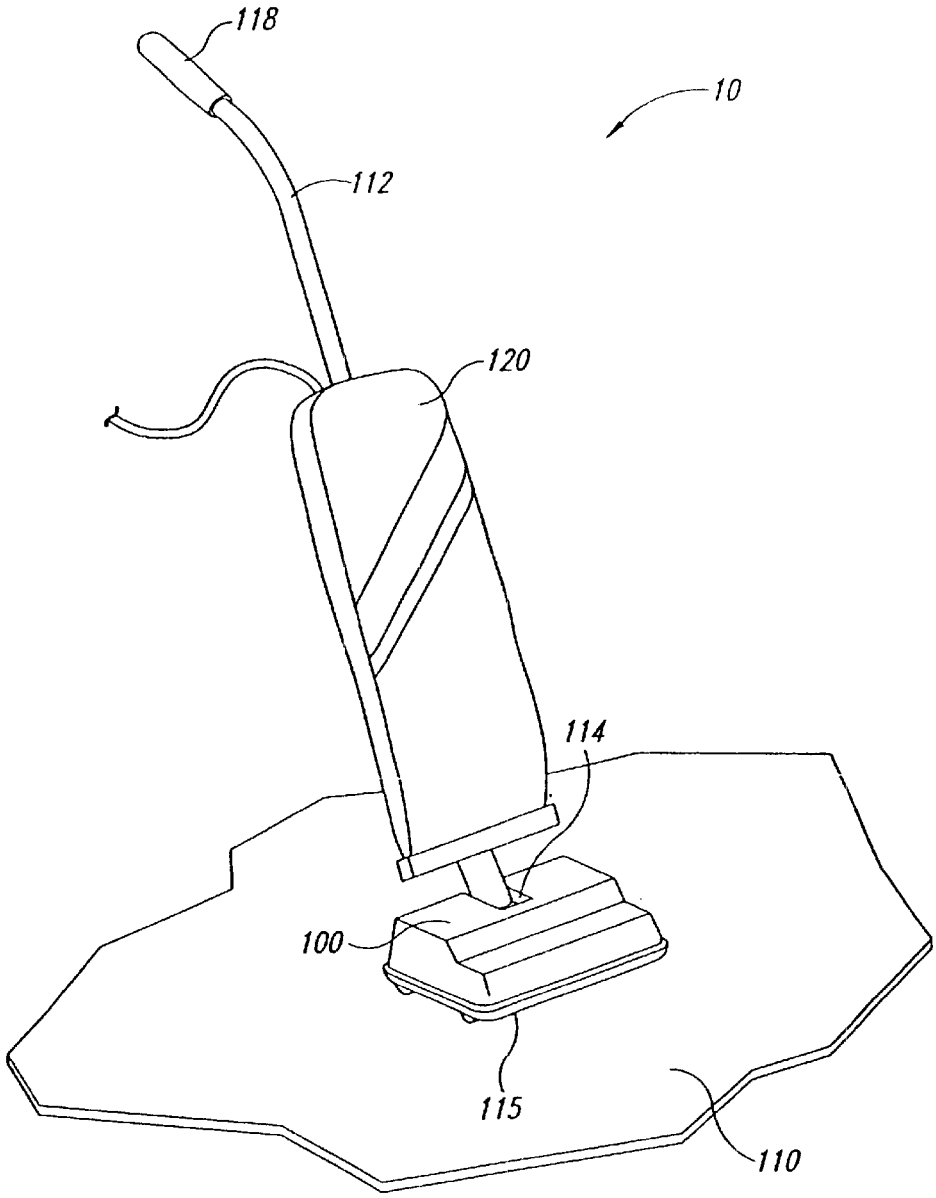
Fig. 1 (Prior Art)
FIG. 1 is a frontal view of an upright vacuum cleaner according to the prior art.
Figure 2:
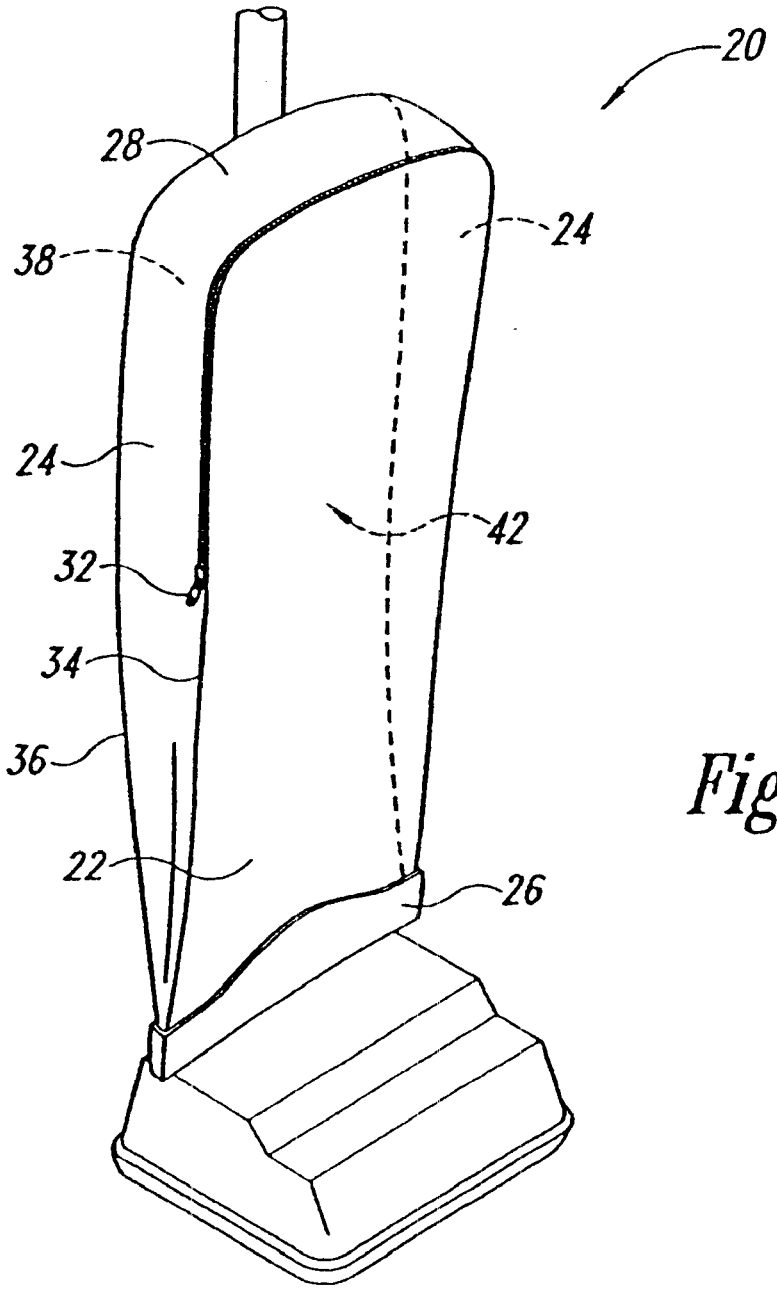
FIG. 2 is an isometric view of an outer bag assembly according to an embodiment of the invention, with other vacuum cleaner components shown schematically and/or broken away.

FIG. 2 is an isometric view of an outer bag assembly according to an embodiment of the invention. The outer bag assembly 20 is comprised of a front panel 22, a pair of side panels 24, a top panel 28, and a back panel 38. A bag clip assembly 26 engages the lower edges of the front panel 22, the back panel 38, and the side panels 24 to enclose the lower portion of the outer bag 20. The bag clip assembly 26 will be described in greater detail below. The front panel 22, back panel 38, and side panels 24 are further attached along an adjacent front peripheral edge 34 and an adjacent back peripheral edge 36 to define an enclosed interior space 42. The front panel 22, back panel 38, side panels 24 and top panel 28 are fabricated from any suitable, air permeable fabric material, such as a woven nylon fabric, a melt-blown and/or spun bond polypropylene or polyethylene material, or other equally suitable materials.

Still referring to FIG. 2, a zipper 32 is disposed along a portion of the front peripheral edge 34 of the front panel 22 to provide a releasable attachment between a portion of the front panel 22 and portions of the side panels 24 and top panel 28. Alternatively, the zipper 32 may be disposed on the top panel 28 and the side panels 24 at an intermediate edge 23 located very close to the front peripheral edge 34. Although FIG. 2 depicts a zipper 32 attaching the front panel 22 to the top panel 28 and the side panels 24, other means for releasably attaching the front panel 22 to the top panel 28 and the side panels 24 exist. For example, the zipper 32 may be replaced by hook-and-loop closures, such as VELCRO®. Alternatively, a pair of zippers may be disposed along the front peripheral edge 34 that share a common zipper track. Still other means for releasably attaching the front panel 22 to the top panel 28 and the side panels 24 may comprise snaps or buttons disposed along the front peripheral edge 34.

Figure 3:
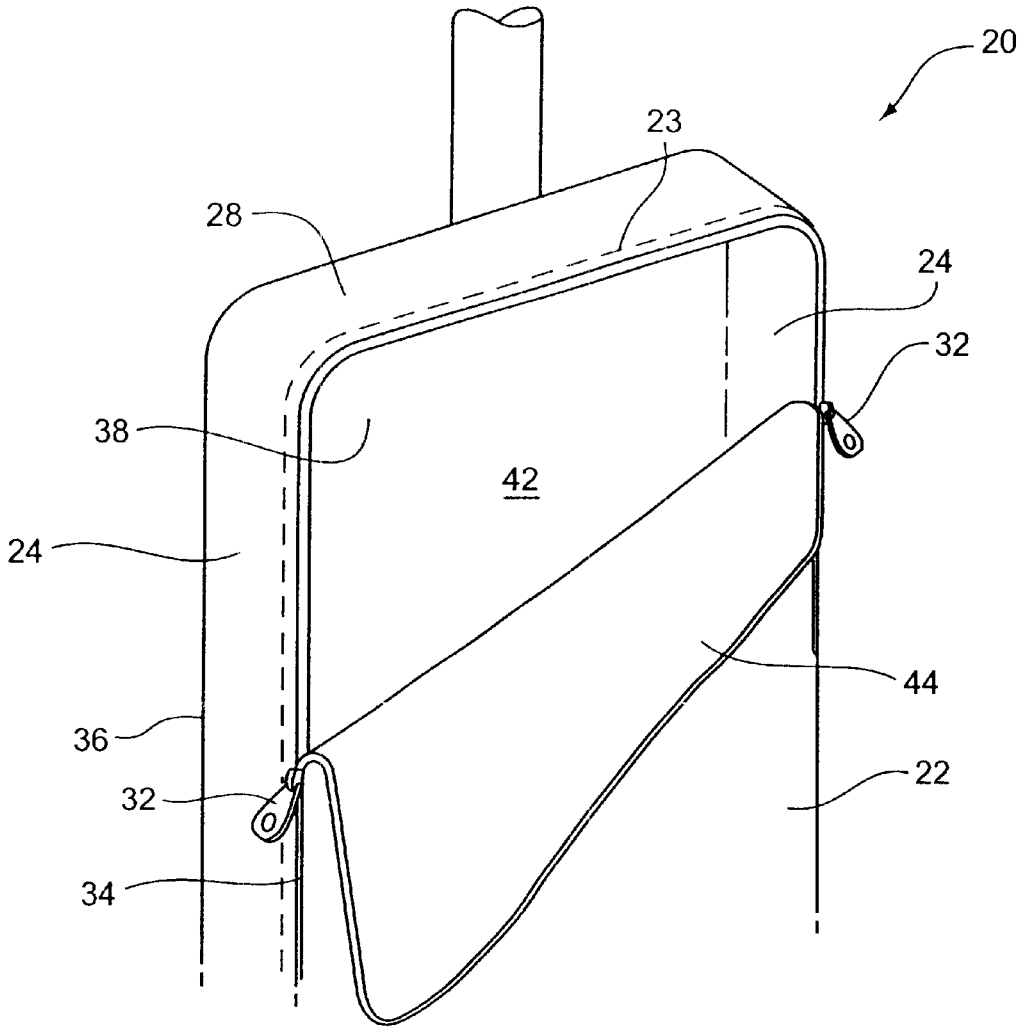
FIG. 3 is a partial isometric view of an outer bag assembly according to an embodiment of the invention, with other vacuum cleaner components shown schematically and/or broken away.

As best seen in FIG. 3, the position of the zipper along the front peripheral edge 34 of the front panel 22 advantageously permits the front panel 22 to be partially detached from the side panels 24 and top panel 28 to access to the interior space 42. Unlike prior art outer bag assemblies that feature a zipper disposed along a midline of the side panels 24 and the top panel 28, the outer bag assembly 20 has the zipper 32 along the peripheral edge 34 of the front panel 22, or alternatively along the intermediate edge 23 located very close to the front peripheral edge 34. When the zipper 32 is unzipped, a portion of the front panel 44 partially overlaps the front panel 22, enabling the user to access the interior region 42 without bending the side panels 24. As a result, the user is more easily able to access an inner bag located within the interior space 42, which minimizes the risk of particulate scattering. Moreover, because the side panels are not substantially bent during this process, the side panels 24 experience less flexure during the opening procedure. Consequently, the side panels 24 experience less wear, and the outer bag assembly 20 retains its original shape and appearance for a greater period of time. In addition, when the material is not substantially bent, it is less prone to fatigue that may cause leaks, thus preserving the secondary filtration capability of the outer bag assembly 20.

Figure 4:
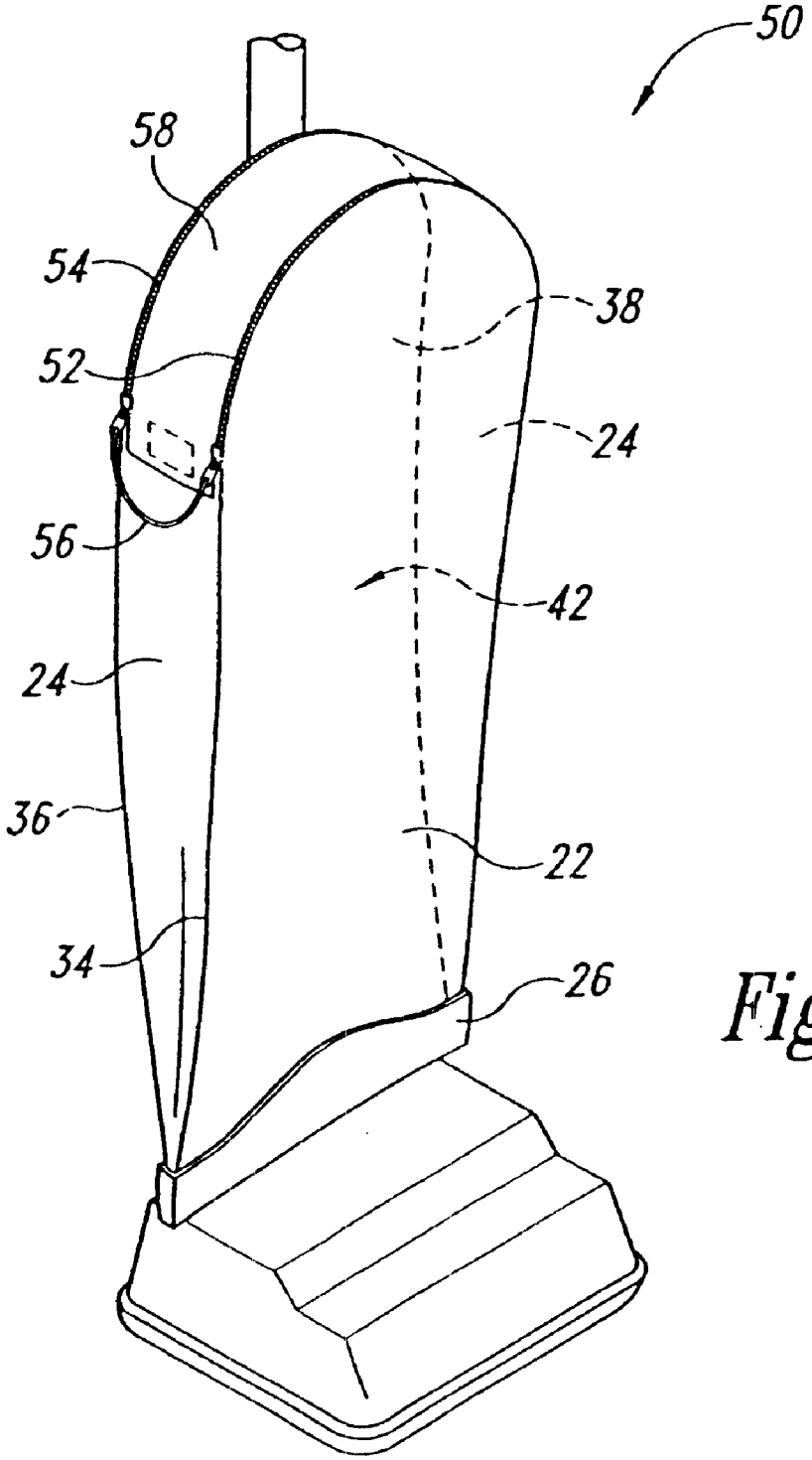
FIG. 4 is an isometric view of an outer bag assembly according to another embodiment of the invention, with other vacuum cleaner components shown schematically and/or broken away.

FIG. 4 is an isometric view of an outer bag assembly according to another embodiment of the invention. The outer bag assembly 50 is comprised of a front panel 22, a pair of side panels 24, an arcuate top panel 58, and a back panel 38. As in the previous embodiment, a bag clip assembly 26 engages the lower edges of the front panel 22, the back panel 38, and the side panels 24 to enclose the lower portion of the outer bag 20. The front panel 22, back panel 38, and side panels 24 are further attached along an adjacent front peripheral edge 34 and an adjacent back peripheral edge 36 to define an enclosed interior space 42. The front panel 22, back panel 38, side panels 24 and top panel 58 are fabricated from any suitable, air permeable fabric material.

With reference still to FIG. 4, a pair of zippers 52 and 54 is disposed along a portion of the front peripheral edge 34 and the back peripheral edge 36. The zippers 52 and 54 provide a releasable attachment between a portion of the front panel 22 and a portion of the back panel 38 that permits the top panel 58 to be partially released from the front panel 22 and the back panel 38. Although FIG. 4 depicts zippers 52 and 54 as the means to release the top panel 58, other equally alternative means for this releasable attachment exist, such as hook-and-loop closures (VELCRO®), or by snaps or buttons disposed along the front peripheral edge 34 and the back peripheral edge 36.

Figure 5:
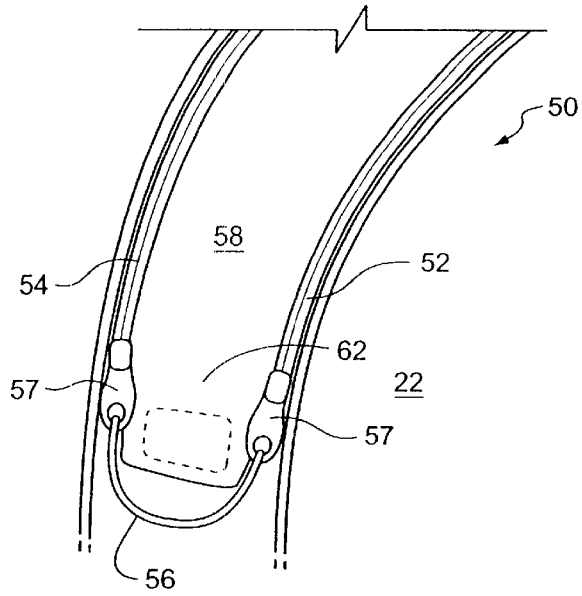
FIG. 5 is a partial isometric view of an outer bag assembly according to another embodiment of the invention.
Figure 6:
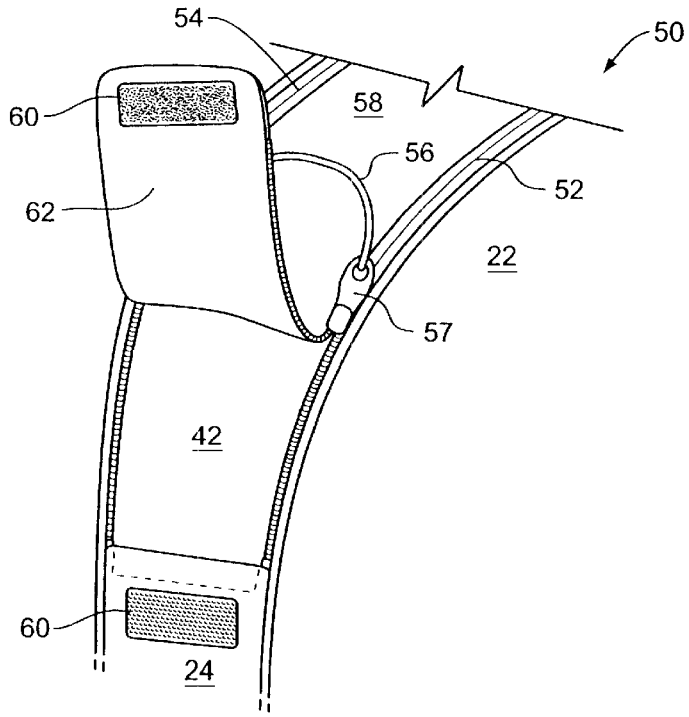
FIG. 6 is a partial isometric view of an outer bag assembly according to yet another embodiment of the invention.
Figure 6A:
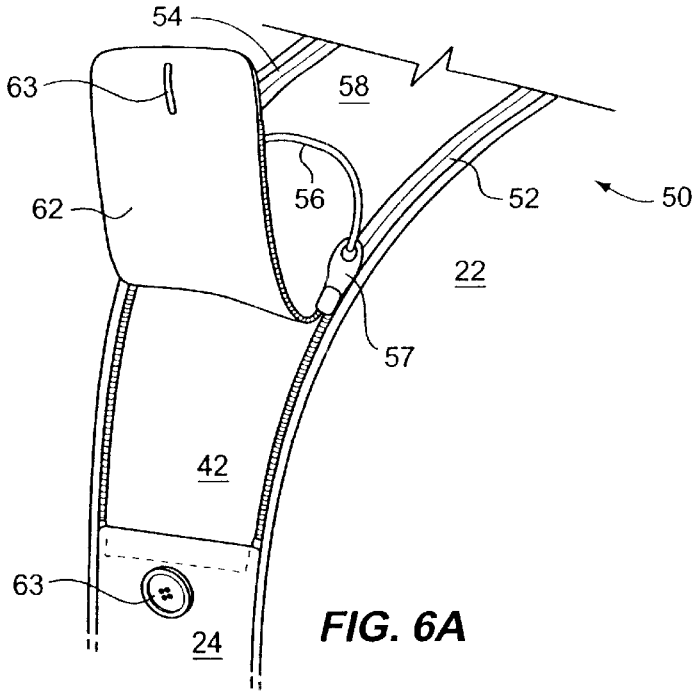
FIG. 6*a* is a partial isometric view of an outer bag assembly according to yet another embodiment of the invention.
Figure 6B:
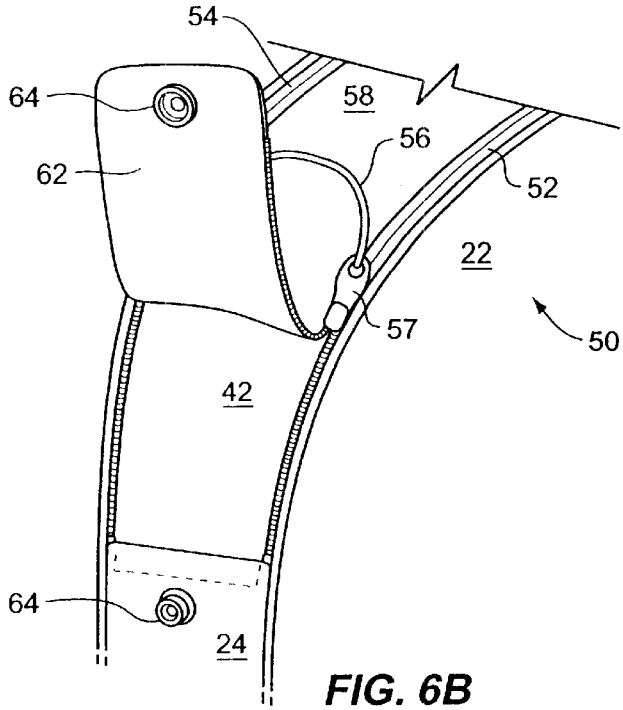
FIG. 6*b* is a partial isometric view of an outer bag assembly according to yet another embodiment of the invention.

Turning now to FIG. 5, the top panel 58 is further comprised of a flap 62 that at least partially overlaps the side panel 24 when the zippers 52 and 54 are moved to the fully closed position. As best seen in FIG. 6, the flap 62 is also comprised of a closure 60 that holds the flap 62 securely to the side panel 24 when the zippers 52 and 54 are fully closed. Although a hook-and-loop closure such as VELCRO® may be used to secure the flap 62 to the side panel 24, other closure means are available, such as snaps 64, as shown in FIG. 6A, or buttons 63, as shown in FIG. 6B. As shown in FIGS. 5, 6, 6A and 6B, the outer bag assembly 50 is further comprised of a tie pull 56 that joins a zipper pull 57 to a zipper pull 58. The inclusion of the tie pull 56 joining the zipper pull 57 to the zipper pull 58 advantageously permits the zippers 52 and 54 to be unzipped simultaneously to access the interior 42 of the bag 50.

FIGS. 6, 6A and 6B further show the top panel 58 of the outer bag assembly 50 in a partially released condition after the zippers 52 and 54 have been partially unzipped. As shown therein, the location of zippers 52 and 54 along the front peripheral edge 34 and the back peripheral edge 36 advantageously permit the top panel 58 to be partially detached from the front panel 22, the back panel 38, and the side panels 24, to allow a portion of the top panel 58 to partially overlap a side panel 24, enabling the user to more easily access the interior region 42 of the outer bag assembly 50 without flexing the side panels 24. As a consequence, the original shape and appearance of the outer bag is retained for a greater period of time.

Figure 7:
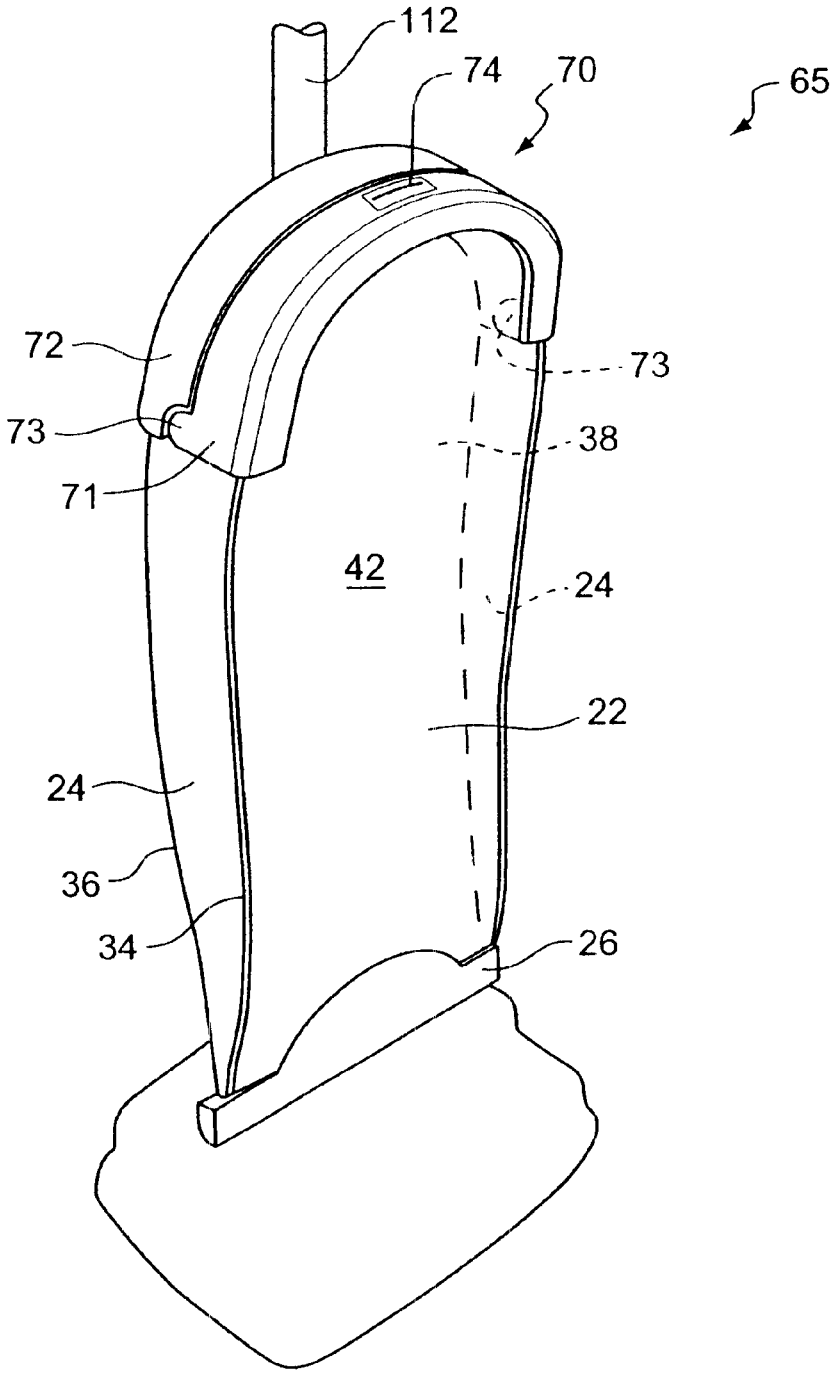
FIG. 7 is an isometric view of an outer bag assembly according to yet another embodiment of the invention, with other vacuum cleaner components shown schematically and/or broken away.
Figure 8:
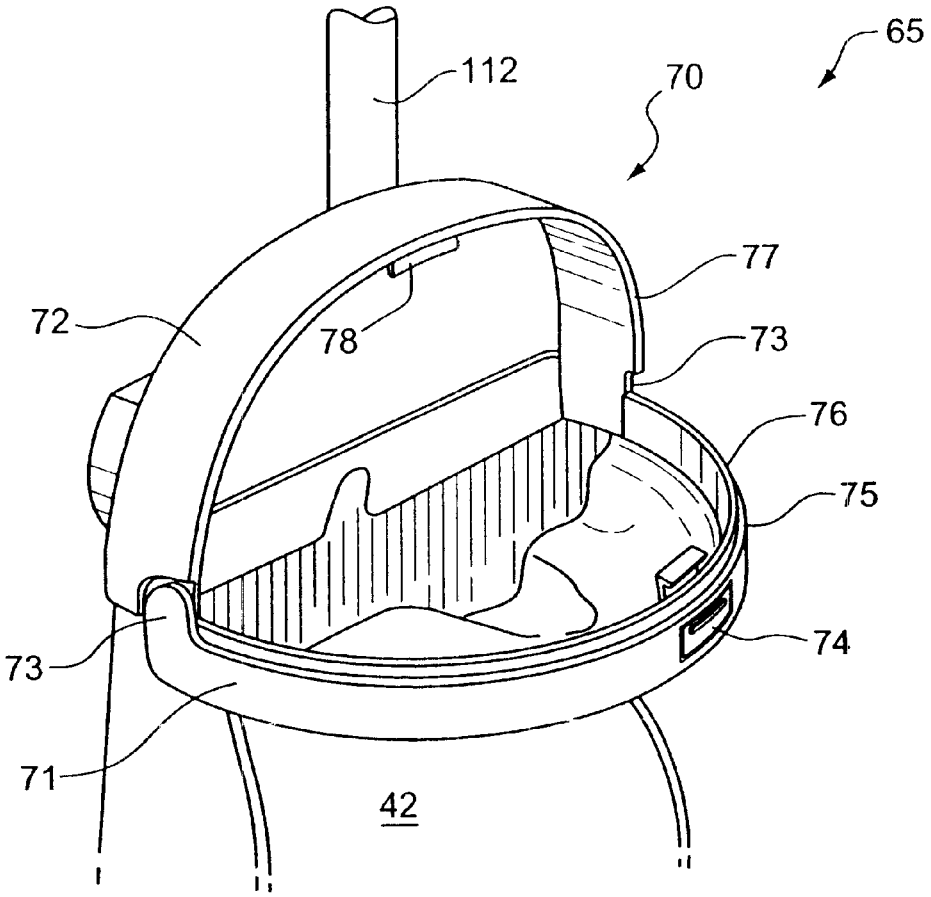
FIG. 8 is a partial isometric view of an outer bag assembly according to still another embodiment of the invention, with other vacuum cleaner components shown schematically and/or broken away.

FIG. 7 is an isometric view of an outer bag assembly according to yet another embodiment of the invention. The outer bag assembly 65 is comprised of a front panel 22, a pair of side panels 24, an arcuate bag cap 70, and a back panel 38. The front panel 22, side panels 24 and back panel 38 are fabricated from any suitable, air permeable fabric material. The bag cap 70 is further comprised of a front section 71 and a rear section 72 that are hingeably connected at hinge points 72 so that the bag cap 70 may be positioned in a closed position, as shown in FIG. 7, or in an open position, as best seen in FIG. 8. The bag cap 70 may be fabricated from any suitable resilient thermoplastic material.

With reference now to FIG. 7, the front section 71 of the bag cap 70 is sealably attached to the side panels 24, and to the front panel 22 along the front peripheral edge 34, and the rear section 72 is sealably attached to the side panels 24, and to the rear panel 38 along the back peripheral edge 36. The rear section 72 is further rigidly attached to the handle assembly 112 by one or more screws, clamps, straps or other such means so that it retains a fixed position relative to the handle assembly 112 when the bag cap 70 is opened or closed. The bag cap 70 is further comprised of a releasable latch mechanism 74 to hold the front section 71 securely latched to the rear section 72 when the bag cap 70 is positioned in the closed position. The latch mechanism 74 is more fully described with reference to FIG. 8. As shown therein, the latch mechanism 74 is comprised of a release plunger 74 coupled to a tapered pawl 75 that lachably engages a catch 78 that is located on the interior wall of the rear section 72 when the bag cap 70 is positioned in the closed position. The release plunger 74 and tapered pawl 75 are tensioned by a spring (not shown), or other resilient member that permits the pawl 75 to lachably engage the catch 78 when the front section 71 is moved to the closed position. The front section 71 is further comprised of a sealing surface 76 which adjoins a substantially overlapping sealing surface 77 located on the rear section 72 when the bag cap 70 is in the closed position.

Still referring to FIG. 8, the bag cap 70 is shown in the open position. As shown therein, releasing the releasable latch mechanism 74 and rotating the front section 71 downwardly conveniently allows access to the interior space 42 of the outer bag assembly 65. The bag cap 70 thus advantageously permits the outer bag assembly 65 to be conveniently opened, enabling the user to more easily access the interior region 42 without flexing the side panels 24. Correspondingly, the original shape and appearance of the outer bag is retained for a longer period of time.

The bag clip assembly 26 will now be more fully described with reference to FIG. 9. The bag clip assembly 26 is comprised of a bag clip front member 80 and a bag clip rear member 81 that engage the bottom edges of the front panel 22, the rear panel 38, and the side panels 24. The bag clip rear member 81 is secured to a bag clip spring 82, which is, in turn, attached to the handle assembly 112 by a bag clip clamp 84. Alternatively, the bag clip spring 82 may be attached to other structure capable of supporting the bag clip assembly 26, such as a dirt suction tube (not shown). A fastener 86 attaches the bag clip clamp 84 to the bag clip spring 82. The bag clip front member 80 and the bag clip rear member 81 are releasably attachable by a plurality of locking tabs 85 located on the bag clip rear member 81 that engage a plurality of locking recesses (not shown) on the bag clip front member 80 that lock the bag clip front member 80 and the bag clip rear member 81 together when the locking tabs 85 are mated with the locking recesses. Alternatively, the locking tabs 85 may be located on the bag clip front member 80, and mate with locking recesses located on the bag clip rear member 81. Other means for attaching the bag clip front member 80 and the bag clip rear member 81 include resiliently joining the members by "snapping" the members together, or by joining with adhesives, or by any other conventional fastening means such as screws.

Figure 9:
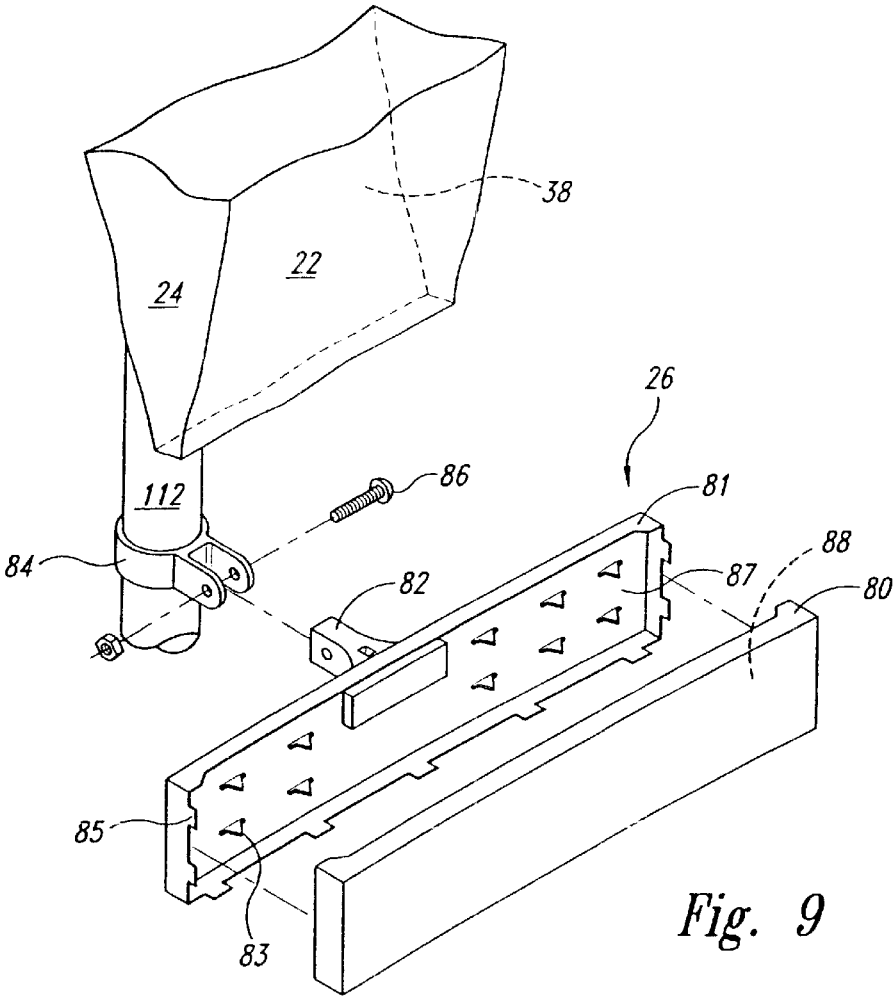
FIG. 9 is a partially exploded isometric view of an aspect of an outer bag assembly according to an embodiment of the invention, with other vacuum cleaner components shown schematically and/or broken away.

With reference still to FIG. 9, the bag clip front member 80 and the bag clip rear member 81 may be further comprised of a plurality of teeth 83 disposed on the outer bag gripping surfaces 87 and 88. The teeth 83 advantageously provide additional compression between the bag clip front member 80 and the bag clip rear member 81 to further secure the lower end of the outer bag assembly within the bag clip assembly 26. As an alternative, the teeth 83 may also project through pre-formed holes in the lower end of the outer bag assembly to further secure the outer bag assembly to the bag clip assembly 26.

Figure 10:
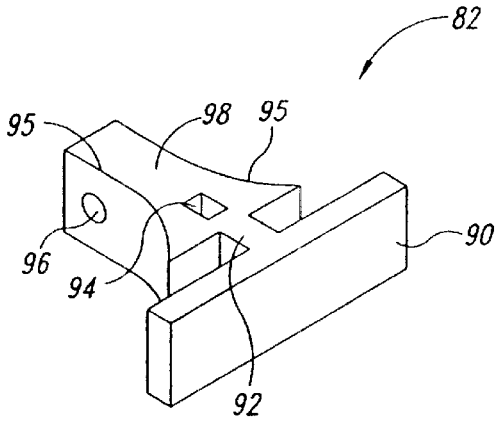
FIG. 10 is an isometric view of an embodiment of a bag clip assembly according to an embodiment of the invention.

FIG. 10 depicts an isometric view of a bag clip spring according to an embodiment of the invention. The bag clip spring 82 comprises a retaining portion 90 that is coupled to a body portion 98 by a coupling portion 92. The body portion 98 has an aperture 94 extending therethrough, and a pair of flexible portions 95 disposed on the opposite sides of the aperture 94. A mounting hole 96 extends through the body portion 98 to receive a bolt or other securing member to attach the bag clip spring 82 to the bag clip clamp 84 (as shown in FIG. 9). The bag clip spring 82 may be fabricated from any suitable material, but preferably is fabricated from a durable, resilient thermoplastic material. Examples of suitable resilient materials include nylon materials, but preferably, the bag clip spring 82 is fabricated from a thermoplastic elastomer such as SANTOPRENE®, or a synthetic rubber. Alternatively, the bag spring clip 82 may be fabricated from a polypropylene material.

Figure 11:
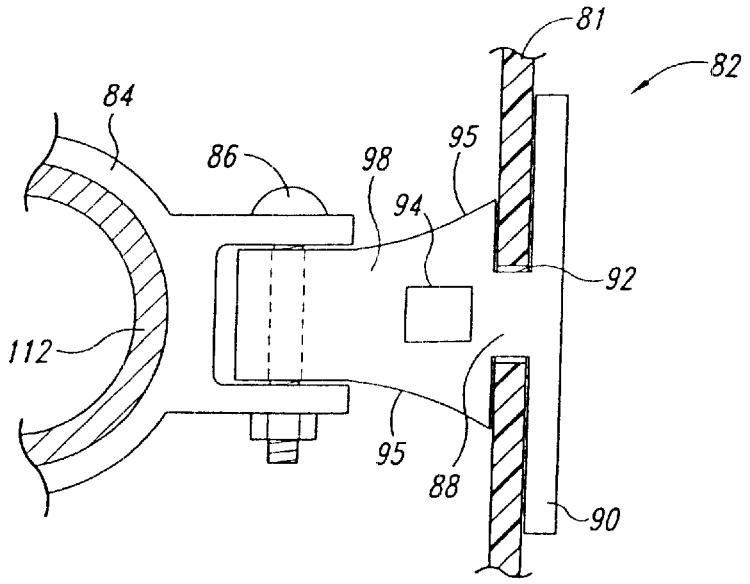
FIG. 11 is a top view of an embodiment of a bag clip assembly according to an embodiment of the invention.

FIG. 11 is a partial cross-sectional top plan view of the bag spring clip 82 engaged with the bag clip rear member 81.

As shown therein, the bag clip rear member 81 has a mounting slot 88 disposed therein. The mounting slot 88 is dimensioned to receive the body portion 98 while still being sufficiently small to prohibit the passage of the retaining portion 90 therethrough. During assembly, the body portion 98 is slipped into the mounting slot 88 and the flexible portions 95 are correspondingly compressed inwardly toward the aperture 94 until the body portion 98 is passed completely through the mounting slot 88. In the assembled position, the coupling portion 92 is positioned within the mounting slot 88 with the retaining portion 90 being engaged against the bag clip rear member 81.

Figure 12:
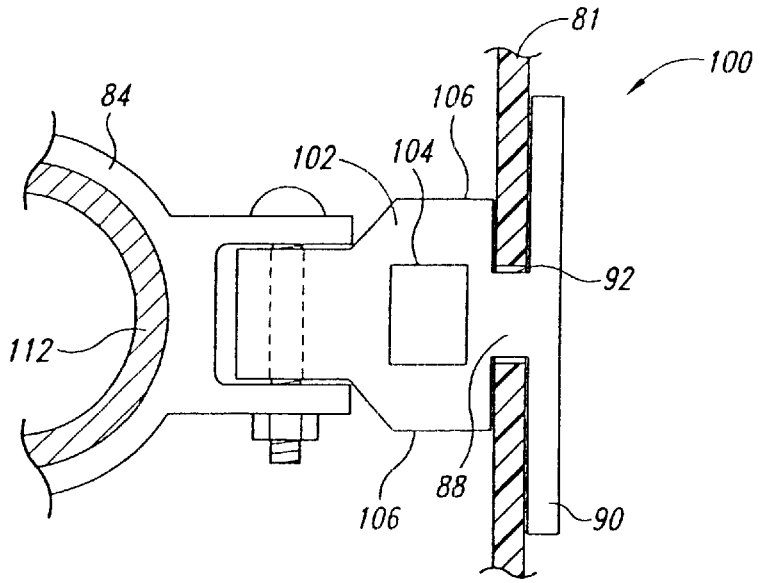
FIG. 12 is a partial cross sectional view of a bag clip assembly according to another embodiment of the invention.

FIG. 12 is a partial cross-sectional top plan view of an alternate embodiment of a bag spring clip 100 engaged with the bag clip rear member 81. In this embodiment, the bag spring clip 100 includes an approximately square-shaped body portion 102 having an aperture 104 disposed therethrough. Flexible portions 106 are disposed on opposite sides of the aperture 104. The bag spring clip 100 is engaged with the bag clip rear member 81 as described above, with the body portion 102 being slipped through the mounting aperture 88 until the coupling portion 92 is disposed within the mounting aperture 88 and the retaining portion 90 is engaged with the bag clip rear member 81.

The various embodiments of the bag spring clip previously described advantageously provide a durable and resilient means for attaching the bag clip assembly 26 to the handle assembly 112. Because the bag spring clip is preferably fabricated from a durable, resilient thermoplastic material, it is not easily permanently deformed or broken in normal use. For example, the bag clip assembly 26 may frequently strike furniture when the vacuum cleaner is in normal use or during transport or storage of the machine. When an object impacts the bag clip assembly 26, the bag spring clip elastically deforms to absorb the force of the blow, returning to its initial shape subsequent to the impact. Consequently, the outer bag assembly requires less repair and maintenance, and may experience longer life.

Figure 13:
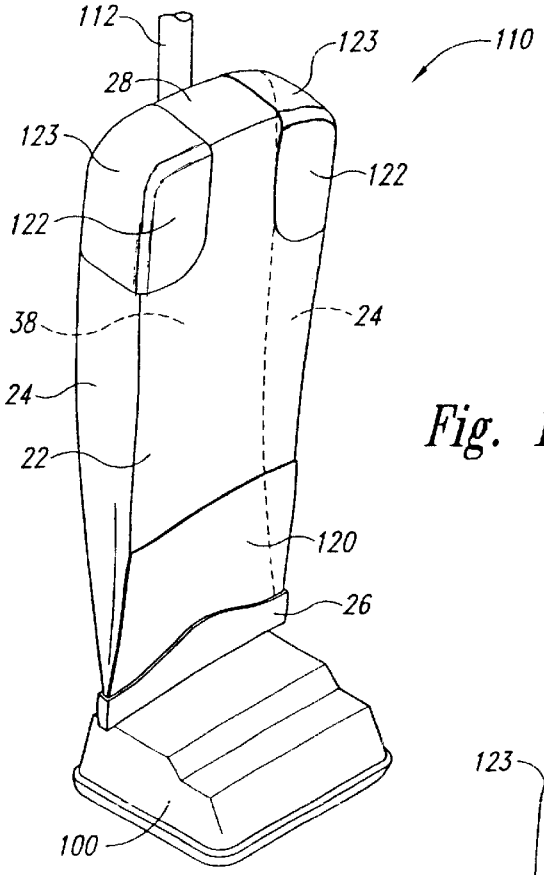
FIG. 13 is an isometric view of an outer bag assembly with abrasion-resistant panels according to yet another embodiment of the invention, with other vacuum cleaner components shown schematically and/or broken away.

FIG. 13 depicts an isometric view of an outer bag assembly according to yet another alternate embodiment of the invention. The outer bag assembly 110 includes a front panel 22, a pair of side panels 24, and a top panel 28 that are fabricated from any suitable, air-permeable fabric material. The outer bag assembly 110 is further comprised of an abrasion-resistant front protective panel 120 positioned on a lower portion of the front panel 22, and abrasion-resistant corner protective panels 122 positioned adjacent to the corners on an upper portion of the front panel 22. Similarly, abrasion-resistant side protective panels 123 are positioned adjacent to the corner protective panels 122 that at least partially overlap the side panels 24 and the top panel 28. The front protective panel 120, corner protective panels 122 and side protective panels 123 are similarly comprised of any suitable, air permeable fabric material. Further, the front protective panel 120, corner protective panels 122 and side protective panels 123 may be affixed to the surfaces of the outer bag assembly 110 by any suitable method. For example, the protective panels 120, 122 and 123 may be stitched to the fabric of the outer bag assembly 110. Alternatively, the protective panels 120, 122 and 123 may be adhesively or thermally bonded to the fabric of the outer bag assembly 110.

Figure 14:
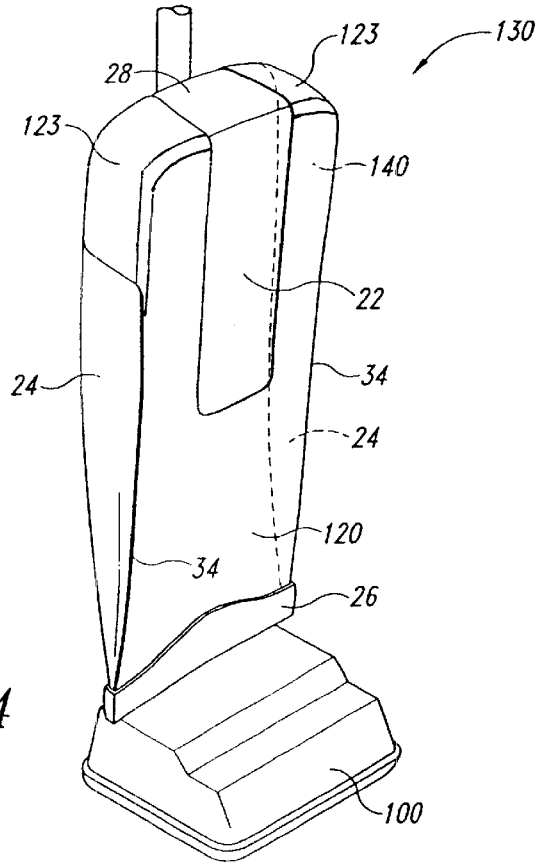
FIG. 14 is an isometric view of an outer bag assembly with abrasion-resistant panels according to yet another alternate embodiment of the invention, with other vacuum cleaner components shown schematically and/or broken away.

FIG. 14 shows an isometric view of an outer bag assembly according to still another embodiment of the invention. As shown therein, the outer bag assembly 130 includes a front panel 22, a pair of side panels 24, and a top panel 28. The outer bag assembly 130 is further comprised of a single, unitary, abrasion-resistant front protective panel 140 that is positioned on the front panel 22 that substantially covers a lower portion of the front panel 22 and further extends upwardly along the front peripheral edge 34 to cover the upper corners of the front panel 22. Abrasion-resistant side protective panels 123 are positioned on the outer bag assembly 130 to at least partially overlap the side panels 24 and the top panel 28. The front protective panel 140 and the side protective panels 123 are similarly comprised of any suitable, air permeable fabric material. Moreover, the front protective panel 140 and the side protective panels 123 may be affixed to the surfaces of the outer bag assembly 130 by any suitable method. For example, the protective panels 140 and 123 may be stitched to the fabric of the outer bag assembly 130. Alternatively, the protective panels 140 and 123 may be adhesively or thermally bonded to the fabric of the outer bag may be affixed to the surfaces of the outer bag assembly 130 by stitching the front protective panel 140 and side protective panels 123 to the fabric of the outer bag assembly 130. Alternatively, the protective panels 140 and 123 may be adhesively or thermally bonded to the fabric of the outer bag assembly 130.

It should be noted that a greater or fewer number of protective panels may be used, and that the shapes and locations of the protective panels may be varied from the aspects shown. Preferably, the protective panels are positioned at locations on the outer bag assembly that are more susceptible to physical damage during normal use. For example, with reference again to FIG. 13, the front panel 22 may be subject to pronounced physical abrasion when the handle assembly 112 is positioned in a lowered position to maneuver the base 100 under a low object like a bed or a chair.

The above description of illustrated embodiments of the invention is not intended to be exhaustive or to limit the invention to the precise form disclosed. While specific embodiments of, and examples of, the invention are described in the foregoing for illustrative purposes, various equivalent modifications are possible within the scope the invention, as those skilled in the relevant art will recognize. Moreover, the various embodiments described above can be combined to provide further embodiments. Accordingly, the invention is not limited by the disclosure, but instead the scope of the invention is to be determined entirely by the following claims.

We claim:

1. An upright vacuum cleaner for cleaning a floor surface, comprising:

a head assembly;

a handle assembly attached to the head assembly for translating the head assembly across the floor surface; and a substantially air-permeable outer bag assembly having an internal volume that is fluidly connected to the blower outlet and adapted to collect debris removed from the floor surface, including a front panel with a top edge, a bottom edge and a pair of opposing longitudinal edges extending therebetween to define a front peripheral edge, a back panel with a top edge, a bottom edge and a pair of opposing longitudinal edges extending therebetween to define a back peripheral edge, the front panel and the rear panel being spaced apart and having a top panel that extends between the top edge of the front panel and the top edge of the rear panel and is attached to the front and back peripheral edges, the outer bag assembly further having a pair of side panels extending between the longitudinal edges of the front and rear panels and attached to the front and back peripheral edges and the top panel, a top closure adapted to be opened and closed to access the internal volume, and a lower closure joining the lower edges of the front and rear panels and the side panels, the lower closure further being attached to the handle assembly.

2. The upright vacuum cleaner according to claim 1 wherein the top closure is further comprised of a releasable closure disposed on the front peripheral edge extending along the entire length of the top edge of the front panel and extending at least partially along the opposing longitudinal edges of the front panel to releasably attach a portion of the front panel.

3. The upright vacuum cleaner according to claim 2 wherein the releasable closure is further comprised of a single zipper with a single zipper slide.

4. The upright vacuum cleaner according to claim 2 wherein the releasable closure is further comprised of a single zipper with at least two zipper slides.

5. The upright vacuum cleaner according to claim 2 wherein the releasable closure is further comprised of a hook and loop closure.

6. The upright vacuum cleaner according to claim 2 wherein the releasable closure is further comprised of plurality of snaps.

7. The upright vacuum cleaner according to claim 2 wherein the releasable closure is further comprised of a plurality of buttons.

8. The upright vacuum cleaner according to claim 1 wherein the top closure is further comprised of a releasable closure disposed on the top panel substantially close to the front peripheral edge and extending along the entire length of the top panel and extending at least partially along the opposing side panels to releasably attach a portion of the front panel.

9. The upright vacuum cleaner according to claim 8 wherein the releasable closure is further comprised of a single zipper with a single zipper slide.

10. The upright vacuum cleaner according to claim 8 wherein the releasable closure is further comprised of a single zipper with at least two zipper slides.

11. The upright vacuum cleaner according to claim 8 wherein the releasable closure is further comprised of a hook and loop closure.

12. The upright vacuum cleaner according to claim 8 wherein the releasable closure is further comprised of a plurality of snaps.

13. The upright vacuum cleaner according to claim 8 wherein the releasable closure is further comprised of a plurality of buttons.

14. The upright vacuum cleaner according to claim 1 wherein the top closure is further comprised of a first releasable closure disposed on the front peripheral edge extending along the entire length of the top edge of the front panel and extending at least partially along the opposing longitudinal edges of the front panel and a second releasable closure disposed on the back peripheral edge extending along the entire length of the top edge of the back panel and extending at least partially along the opposing longitudinal edges of the back panel to releasably attach a portion of the top panel.

15. The upright vacuum cleaner according to claim 14 wherein the first releasable closure is further comprised of a first zipper with a first zipper slide, and the second releasable closure is further comprised of a second zipper with a second zipper slide.

16. The upright vacuum cleaner according to claim 15 wherein the first and second releasable closures are further comprised of a pull joining the first and second zipper slides.

17. The upright vacuum cleaner according to claim 14 wherein the first and second releasable closures are further comprised of a hook and loop closure.

18. The upright vacuum cleaner according to claim 14 wherein the first and second releasable closures are further comprised of plurality of snaps.

19. The upright vacuum cleaner according to claim 14 wherein the first and second releasable closures are further comprised of a plurality of buttons.

20. The upright vacuum cleaner according to claim 14 wherein the top panel is further comprised of a flap that extends at least partially over the side panel that is releasably attached to the side panel with a hook and loop closure.

21. The upright vacuum cleaner according to claim 1 wherein the top closure is further comprised of a bag cap having a front section that is hingeably connected to a rear section, the front section being adapted to rotate about an axis parallel to the top edge of the front panel, and the rear section being attached to the handle assembly.

22. The upright vacuum cleaner according to claim 21 wherein the bag cap is further comprised of front and rear sections having an arcuate shape.

23. The upright vacuum cleaner according to claim 21 wherein the front and rear sections are comprised of a resilient thermoplastic material.

24. The upright vacuum cleaner according to claim 21 wherein the bag cap is further comprised of a releasable latch mechanism.

25. The upright vacuum cleaner according to claim 24 wherein the releasable latch mechanism is further comprised of a release plunger and tapered pawl attached to the front section and a catch attached to the rear section, the tapered pawl engaging the catch to latchably secure the bag cap.

26. The upright vacuum cleaner according to claim 1 wherein the front panel is further comprised of a front protective panel positioned on the front panel that is adjacent to the lower edge and extends between the longitudinal edges and upwardly to at least partially cover the front panel.

27. The upright vacuum cleaner according to claim 26 wherein the top panel is further comprised of a pair of side protective panels positioned on the top panel that extend between the front and rear peripheral edges to at least partially cover the top panel and extending downwardly from the top surface to at least partially cover the side panels.

28. The upright vacuum cleaner according to claim 27 wherein the front panel is further comprised of a first corner protective panel positioned on the front panel adjacent to the top edge of the front panel and a longitudinal edge of the front panel, and a second corner protective panel positioned on the front panel adjacent to the top edge of the front panel and the opposing longitudinal edge, the first and second corner protective panels extending downwardly from the upper edge to at least partially cover the front panel.

29. The upright vacuum cleaner according to claim 1 wherein the lower closure is further comprised of a bag clip front member and an opposing bag clip rear member adapted to releasably engage therebetween the lower edges of the front panel, back panel and side panels, the bag clip rear member being further attached to a resilient bag spring clip that attaches to the handle assembly.

30. The upright vacuum cleaner according to claim 29 wherein the bag clip front member and the bag clip rear member are further comprised of gripping surfaces to releasably engage therebetween the lower edges of the front panel, back panel and side panels.

31. The upright vacuum cleaner according to claim 30 wherein the gripping surfaces further comprise a plurality of teeth.

32. The upright vacuum cleaner according to claim 29 wherein the resilient bag spring clip is comprised of a resilient thermoplastic material.

33. The upright vacuum cleaner according to claim 1 wherein the outer bag assembly is further comprised of a disposable inner bag.

34. A substantially air-permeable outer bag assembly having an internal volume comprising:

a front panel with a top edge, a bottom edge and a pair of opposing longitudinal edges extending therebetween to define a front peripheral edge;

a back panel with a top edge, a bottom edge and a pair of opposing longitudinal edges extending therebetween to define a back peripheral edge, the front panel and the rear panel being spaced apart;

a top panel extending between the top edge of the front panel and the top edge of the rear panel and attached to the front and back peripheral edges;

a pair of side panels extending between the longitudinal edges of the front and rear panels and attached to the front and back peripheral edges and the top panel;

a releasable closure adapted to release at least a portion of the front panel to access the internal volume; and a lower closure adapted to enclose the lower edges of the front and rear panels and the side panels.

35. The outer bag assembly according to claim 34 wherein the releasable closure is further comprised of a single zipper with a single zipper slide disposed on the front peripheral edge extending along the entire length of the top edge of the front panel and extending at least partially along the opposing longitudinal edges.

36. The outer bag assembly according to claim 34 wherein the releasable closure is further comprised of a single zipper with at least two zipper slides disposed on the front peripheral edge and extending along the entire length of the top edge of the front panel and extending at least partially along the opposing longitudinal edges.

37. The outer bag assembly according to claim 34 wherein the releasable closure is further comprised of a hook and loop closure disposed on the front peripheral edge and extending along the entire length of the top edge of the front panel and extending at least partially along the opposing longitudinal edges.

38. The outer bag assembly according to claim 34 wherein the releasable closure is further comprised of a plurality of snaps disposed on the front peripheral edge and extending along the entire length of the top edge of the front panel and extending at least partially along the opposing longitudinal edges.

39. The outer bag assembly according to claim 34 further comprising a disposable inner bag positioned within the internal volume.

40. A substantially air-permeable outer bag assembly having an internal volume comprising:

a front panel with a top edge, a bottom edge and a pair of opposing longitudinal edges extending therebetween to define a front peripheral edge;

a back panel with a top edge, a bottom edge and a pair of opposing longitudinal edges extending therebetween to define a back peripheral edge, the front panel and the rear panel being spaced apart;

a top panel extending between the top edge of the front panel and the top edge of the rear panel and attached to the front and back peripheral edges;

a pair of side panels extending between the longitudinal edges of the front and rear panels and attached to the front and back peripheral edges and the top panel;

a releasable closure adapted to release at least a portion of the top panel to access the internal volume; and a lower closure adapted to enclose the lower edges of the front and rear panels and the side panels.

41. The outer bag assembly according to claim 40 wherein the releasable closure is further comprised of a first zipper with a first zipper slide on the front peripheral edge extending along the entire length of the top edge of the front panel and extending at least partially along the opposing longitudinal edges of the front panel and a second zipper slide disposed on the back peripheral edge extending along the entire length of the top edge of the back panel and extending at least partially along the opposing longitudinal edges of the back panel.

42. The outer bag assembly according to claim 40 wherein the releasable closure is further comprised of a pull joining the first and second zipper slides.

43. The outer bag assembly according to claim 40 wherein the top panel is further comprised of a flap that extends at least partially over a side panel that is releasably attached to the side panel with a hook and loop closure.

44. The outer bag assembly according to claim 40 wherein the releasable closure is further comprised of a first plurality of hook and loop closures disposed on the front peripheral edge and extending along the entire length of the top edge of the front panel and extending at least partially along the opposing longitudinal edges, and a second plurality of hook and loop closures disposed on the back peripheral edge extending along the entire length of the top edge of the back panel and extending at least partially along the opposing longitudinal edges of the back panel.

45. The outer bag assembly according to claim 40 wherein the releasable closure is further comprised of a first plurality of snaps disposed on the front peripheral edge and extending along the entire length of the top edge of the front panel and extending at least partially along the opposing longitudinal edges, and a second plurality of snaps disposed on the back peripheral edge extending along the entire length of the top edge of the back panel and extending at least partially along the opposing longitudinal edges of the back panel.

46. The outer bag assembly according to claim 40 wherein the releasable closure is further comprised of a first plurality of buttons disposed on the front peripheral edge and extending along the entire length of the top edge of the front panel and extending at least partially along the opposing longitudinal edges, and a second plurality of buttons disposed on the back peripheral edge extending along the entire length of the top edge of the back panel and extending at least partially along the opposing longitudinal edges of the back panel.

47. The outer bag assembly according to claim 40 further comprising a disposable inner bag positioned within the internal volume.

48. A substantially air-permeable outer bag assembly having an internal volume comprising:

a front panel with a top edge, a bottom edge and a pair of opposing longitudinal edges extending therebetween to define a front peripheral edge;

a back panel with a top edge, a bottom edge and a pair of opposing longitudinal edges extending therebetween to define a back peripheral edge, the front panel and the rear panel being spaced apart;

a pair of side panels extending between the longitudinal edges of the front and rear panels and attached to the front and back peripheral edges and the top panel;

a bag cap having a front section that is hingebly connected to a rear section, the front section being attached to the top edge of the front panel and at least partially to the side panels, the rear section being attached to the top edge of the back panel and at least partially to the side panels, the front and rear sections being adapted to rotate about an axis parallel to the top edge of the front panel to provide a hingeable access the internal volume; and a lower closure adapted to enclose the lower edges of the front and rear panels and the side panels.

49. The outer bag assembly according to claim 48 wherein the bag cap is further comprised of front and rear sections having an arcuate shape.

50. The outer bag assembly according to claim 48 wherein the front and rear sections are comprised of a resilient thermoplastic material.

51. The outer bag assembly according to claim 48 wherein the bag cap is further comprised of a releasable latch mechanism.

52. The outer bag assembly according to claim 48 wherein the releasable latch mechanism is further comprised of a release plunger and tapered pawl attached to the front section and a catch attached to the rear section, the tapered pawl engaging the catch to latchably secure the bag cap.

53. The outer bag assembly according to claim 48 further comprising a disposable inner bag positioned within the internal volume.

54. A substantially air-permeable outer bag assembly having an internal volume comprising:

a front panel with a top edge, a bottom edge and a pair of longitudinal edges extending therebetween to define a front peripheral edge;

a back panel, spaced apart from the front panel, with a top edge, a bottom edge and a pair of opposing longitudinal edges extending therebetween to define a back peripheral edge;

a top panel extending between the top edge of the front panel and the top edge of the rear panel and attached to the front and back peripheral edges;

a pair of side panels extending between the longitudinal edges of the front and rear panels and attached to the front and back peripheral edges and the top panel; and at least one protective panel integral to at least one of said front, back, top and side panels.

55. The outer bag assembly according to claim 54 wherein the front panel is further comprised of a front protective panel positioned on the front panel that is adjacent to the lower edge and extends between the longitudinal edges and upwardly to at least partially cover the front panel.

56. The outer bag assembly according to claim 54 wherein the top panel is further comprised of a pair of side protective panels positioned on the top panel that extend between the front and rear peripheral edges to at least partially cover the top panel and extending downwardly from the top surface to at least partially cover the side panels.

57. The outer bag assembly according to claim 54 wherein the front panel is further comprised of a first corner protective panel positioned on the front panel adjacent to the top edge of the front panel and a longitudinal edge of the front panel, and a second corner protective panel positioned on the front panel adjacent to the top edge of the front panel and the opposing longitudinal edge, the first and second corner protective panels extending downwardly from the upper edge to at least partially cover the front panel.

58. The outer bag assembly according to claim 54 wherein the front panel is further comprised of a front protective panel positioned on the front panel that is adjacent to the lower edge and extends between the longitudinal edges and upwardly to at least partially cover the front panel, a first corner protective panel positioned on the front panel adjacent to the top edge of the front panel and a longitudinal edge of the front panel, and a second corner protective panel positioned on the front panel adjacent to the top edge of the front panel and the opposing longitudinal edge, the first and second corner protective panels extending downwardly from the upper edge to at least partially cover the front panel.

59. The outer bag assembly according to claim 54 wherein the front panel is further comprised of a unitary front protective panel having a lower portion and a bifurcated upper portion, the upper portion having a first furcated portion and a second furcated portion, the front protective panel being positioned on the front panel with the lower portion adjacent to the lower edge and extending between the longitudinal edges and upwardly to at least partially cover the front panel, the first furcated portion extending from the lower portion upwardly along the front panel and adjacent to longitudinal edge of the front panel to at least partially adjoin the top edge of the front panel, and the second furcated portion extending from the lower portion upwardly along the front panel and adjacent to the opposing longitudinal edge of the front panel to at least partially adjoin the top edge of the front panel.

60. In an upright vacuum cleaner having a handle assembly and an outer bag assembly with a lower end, a bag closure comprising:

a bag clip front member having an outer face and an inner engaging surface;

a bag clip rear member having an outer face and an inner engaging surface, the bag clip front member and the bag clip rear member forming a gripping recess adapted to releasably grip the lower end of the outer bag assembly when the inner engaging surface of the bag clip front member and the inner engaging surface of the bag clip rear member are lockably joined, the bag clip rear member further having a mounting slot;

a substantially resilient bag spring clip having a first end and a second end, the first end adapted to lockably engage the mounting slot in the bag clip rear member, and the second end adapted to releasably engage the handle assembly.

61. The bag closure according to claim 60 wherein the inner engaging surface of the bag clip front member and the inner engaging surface of the bag clip rear member include a plurality of teeth adapted to engage the lower end of the outer bag assembly.

62. The bag closure according to claim 60 wherein the bag spring clip is further comprised of a retaining portion and a body portion coupled by a coupling portion, the coupling portion adapted to engage the mounting slot in the bag clip rear member.

63. The bag spring clip according to claim 62 further comprising an aperture projecting through the body portion.

64. The bag closure according to claim 60 wherein the bag spring clip is further comprised of a thermoplastic material.

65. The bag closure according to claim 60 wherein the bag spring clip is further comprised of a nylon material.

66. The bag closure according to claim 60 wherein the bag spring clip is further comprised of a synthetic rubber.

67. The bag closure according to claim 60 wherein the bag spring clip is further comprised of SANTOPRENE®.

68. The bag closure according to claim 60 wherein the bag spring clip is further comprised of polypropylene.

* * * * *